US010269514B2

(12) United States Patent
Daugherty et al.

(10) Patent No.: US 10,269,514 B2
(45) Date of Patent: Apr. 23, 2019

(54) OVERSIZED NOVELTY WALL SWITCH

(71) Applicants: Benjamin A Daugherty, Lakewood, CO (US); Dale G Daugherty, Lakewood, CO (US)

(72) Inventors: Benjamin A Daugherty, Lakewood, CO (US); Dale G Daugherty, Lakewood, CO (US)

( * ) Notice: Subject to any disclaimer, the term of this patent is extended or adjusted under 35 U.S.C. 154(b) by 17 days.

(21) Appl. No.: 15/597,415

(22) Filed: May 17, 2017

(65) Prior Publication Data

US 2018/0337011 A1 Nov. 22, 2018

(51) Int. Cl.
*H01H 23/14* (2006.01)
*H01H 11/00* (2006.01)

(52) U.S. Cl.
CPC ..... *H01H 23/141* (2013.01); *H01H 11/00* (2013.01); *H01H 11/0006* (2013.01)

(58) Field of Classification Search
CPC ..... H01H 23/141; H01H 2221/024; H01H 2221/026; H01H 2221/028; H01H 2221/056; H01H 2221/066; H01H 2221/08; H01H 11/0006
USPC ..... 200/329–331
See application file for complete search history.

(56) References Cited

U.S. PATENT DOCUMENTS 2,574,933 A 11/1951 Ogren
2,668,456 A 2/1954 Meistrell
2,712,582 A 7/1955 Peretti
3,121,778 A * 2/1964 Sander ..... H01H 23/141 200/331
3,188,439 A 6/1965 Fullerton
3,581,037 A 5/1971 Schiffelbein
3,722,319 A 3/1973 Reznik
3,816,686 A * 6/1974 Budd ..... H01H 23/148 200/330
4,234,774 A * 11/1980 Paparella ..... H01H 9/18 200/330
4,256,943 A 3/1981 Whitlock
4,562,325 A 12/1985 Rouen
4,590,345 A 5/1986 Marshell
4,731,511 A 3/1988 Steinhilber
4,745,243 A 5/1988 Wang
4,972,045 A * 11/1990 Primeau ..... H01H 15/10 174/66
D326,445 S 5/1992 Enyeart
D352,277 S 11/1994 Olsen
5,380,967 A 1/1995 Steen
D355,643 S 2/1995 Warnock
5,900,584 A 5/1999 Cady
6,822,177 B1 11/2004 LaPlante
7,214,898 B1 5/2007 Margareten
(Continued)

*Primary Examiner* — Felix O Figueroa
(74) *Attorney, Agent, or Firm* — Leyendecker & Lemire, LLC

(57) ABSTRACT

An operational oversized wall switch cover assembly is is designed to be installed over an existing switch without removing the switch's wall plate. The assembly includes linkage that facilitates the turning off or on of the existing switch by moving an oversized toggle between off and on positions. The assembly is customizable using a variety of different colored components for the cover, slide trim plate and toggle. Further, the assembly's cover provides a significant area to imprint indicia thereon, such as logos of a favorite sports team or a child's favorite cartoon characters.

19 Claims, 14 Drawing Sheets

(56) References Cited

U.S. PATENT DOCUMENTS

| | | | |
|---|---|---|---|
| D615,048 | S | 5/2010 | Grisby |
| 8,253,049 | B2 | 8/2012 | Grisby |
| 2009/0014197 | A1 | 1/2009 | Eastin |

* cited by examiner

OVERSIZED NOVELTY WALL SWITCH

BACKGROUND

Novelty items provide levity and humor. Novelty wall switches or switch plate covers are known in the art generally taking on the form of characters, such as animals, or faces, such as a clown. Most often the switch covers, which are mounted on around an existing toggle switch replacing a standard wall plate, are designed and configured to amuse and delight children. Sometimes these child-centric switch covers also include features that make the actuation of the switch easier for children, such as an extension arm that would permit a child to turn the switch off and on even though he/she is too small to reach the switch without the novelty cover.

BRIEF DESCRIPTION OF THE FIGURES

FIG. 5 is a perspective front view of the slider assembly with the cover, toggle, slide trim plate and the slider removed according to the embodiment of the present invention.

DETAILED DESCRIPTION

Figure 1:
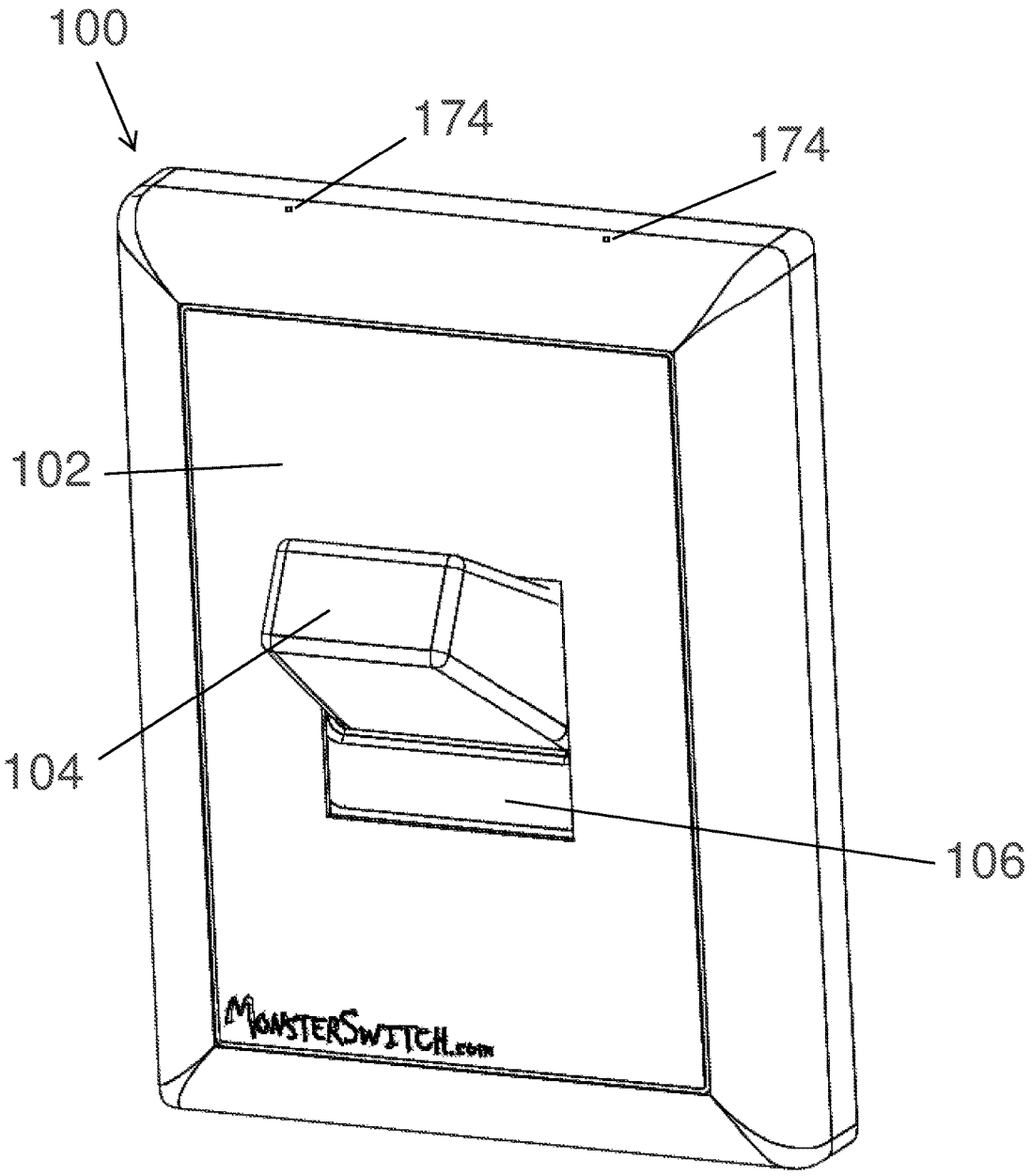
FIG. 1 is a perspective front view of an oversized operational novelty wall switch cover assembly according to an embodiment of the present invention.
Figure 2:
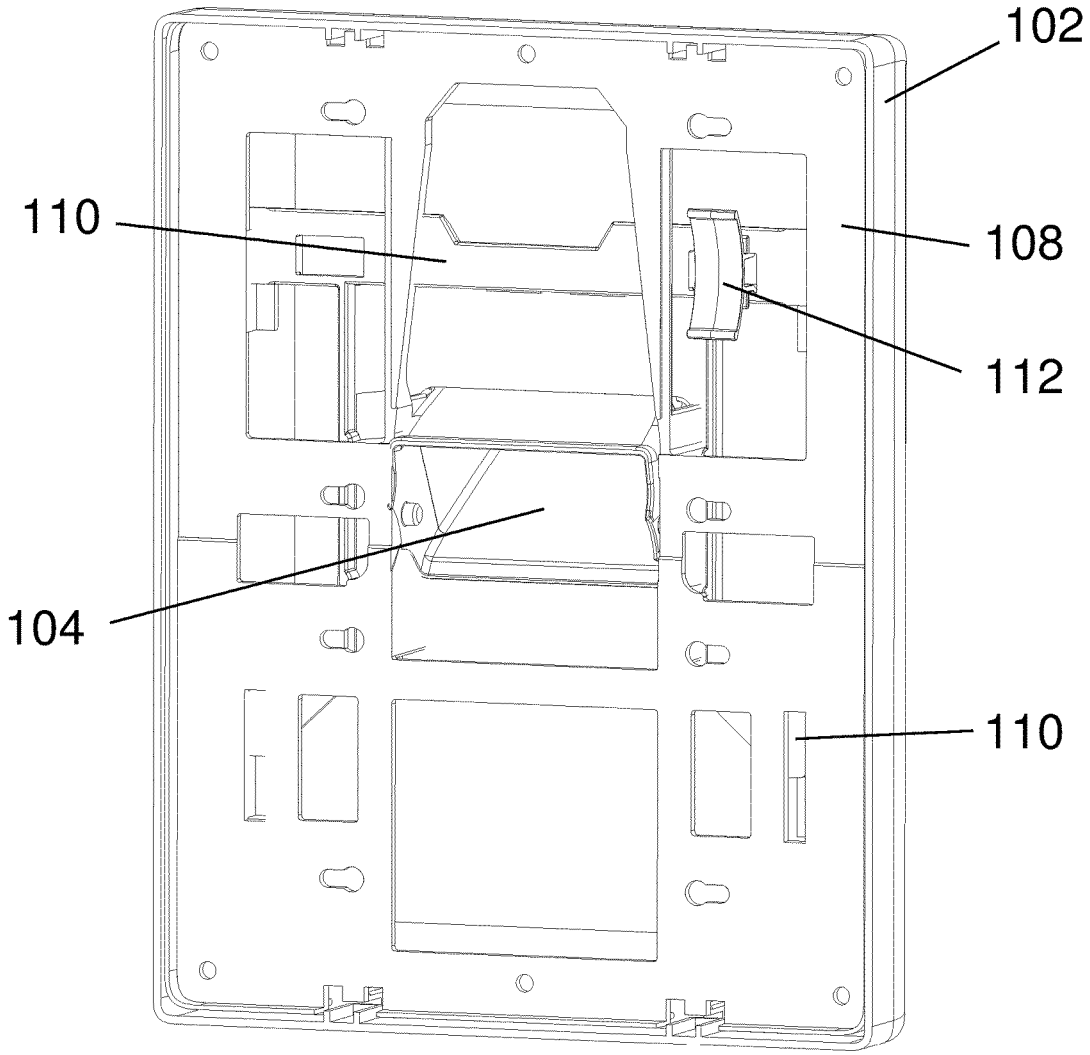
FIG. 2 is a perspective rear view of the oversized operational novelty wall switch cover assembly according to an embodiment of the present invention.
Figure 3:
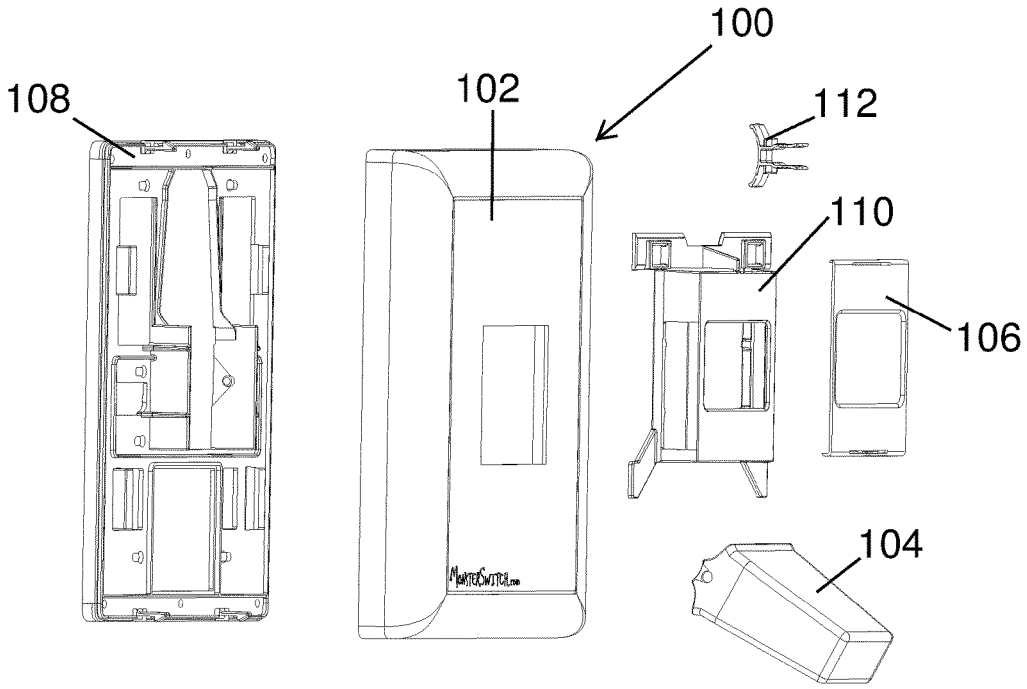
FIG. 3 is an exploded perspective view of oversized operational novelty wall switch cover assembly according to the embodiment of the present invention.

Embodiments of the present invention comprise an operational oversized wall switch cover assembly. The assembly is designed to be installed over an existing switch without removing the switch's wall plate. The assembly includes a sliding linkage that facilitates the turning off or on of the existing switch by moving an oversized toggle or lever between off and on positions. The operational characteristics of the switch, its huge size and farcical nature make it particularly noticeable in a room inviting humorous comments, smiles and laughter. Further, the assembly's cover comprises a significant area providing significant space to imprint indicia. A switch assembly intended for a child's room might include Disney™ characters imprinted thereon; whereas, an assembly intended for a man cave might include the colors and logo of a favorite football team.

Although the size of the switch assembly can vary in at least one embodiment, it is about 10.0" by 7.5" with a toggle switch extending outwardly from the cover over 2". Because of the size and considering that wall switches are often located near doorways, the configuration of the assembly allows for at least two mounting positions relative to the wall switch it overlays to help ensure it will fit in most installations.

In at least some embodiments, the cover, slide trim plate and the toggle lever are easily replaceable and interchangeable. For instance during football season, the switch assembly may sport an orange wall plate emblazed with the Denver Broncos™ logo and a blue toggle lever, but in baseball season, the cover may be switched out for one sporting Colorado Rockies™ colors and logo with a silver slide trim plate and a purple toggle lever. In one embodiment both the cover and toggle lever are snappily secured to the mounting plate.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, upper, lower, vertical, horizontal, back, front and lateral are relative to each other and are dependent on the specific orientation of an applicable element or article, and are used accordingly to aid in the description of the various embodiments and are not necessarily intended to be construed as limiting.

The terms "light switch" and "wall switch" are used herein interchangeably and refer to any standard wall mounted switch used to either turn off or on lights within a room or turn power off and on to a particular electrical socket in a room.

The term "toggle lever" is used herein to refer to the lever provided on a standard light switch, as well as, the lever provided with the oversized wall switch cover assembly. The toggle lever of the assembly is typically referred to as the "large toggle switch lever" although regardless which lever is being referred to is evident in context.

An Embodiment of an Operational Oversized Wall Switch Cover Assembly

FIGS. 1-4 & 11-12 illustrate an oversized novelty light switch assembly 100. The assembly comprises five major components: a mounting plate 108; a large toggle lever 104; a sliding member 110 (or "slider"); an slide trim plate 106 and a cover 102. These components are typically comprised of a suitable plastic material and are molded using any suitable means, such as injection molding. One embodiment of the assembly comprises components molded of ABS plastic. In addition to the major components, mounting fasteners and spacers can be provided such as may be required to mount the assembly over a light switch.

Figure 4:
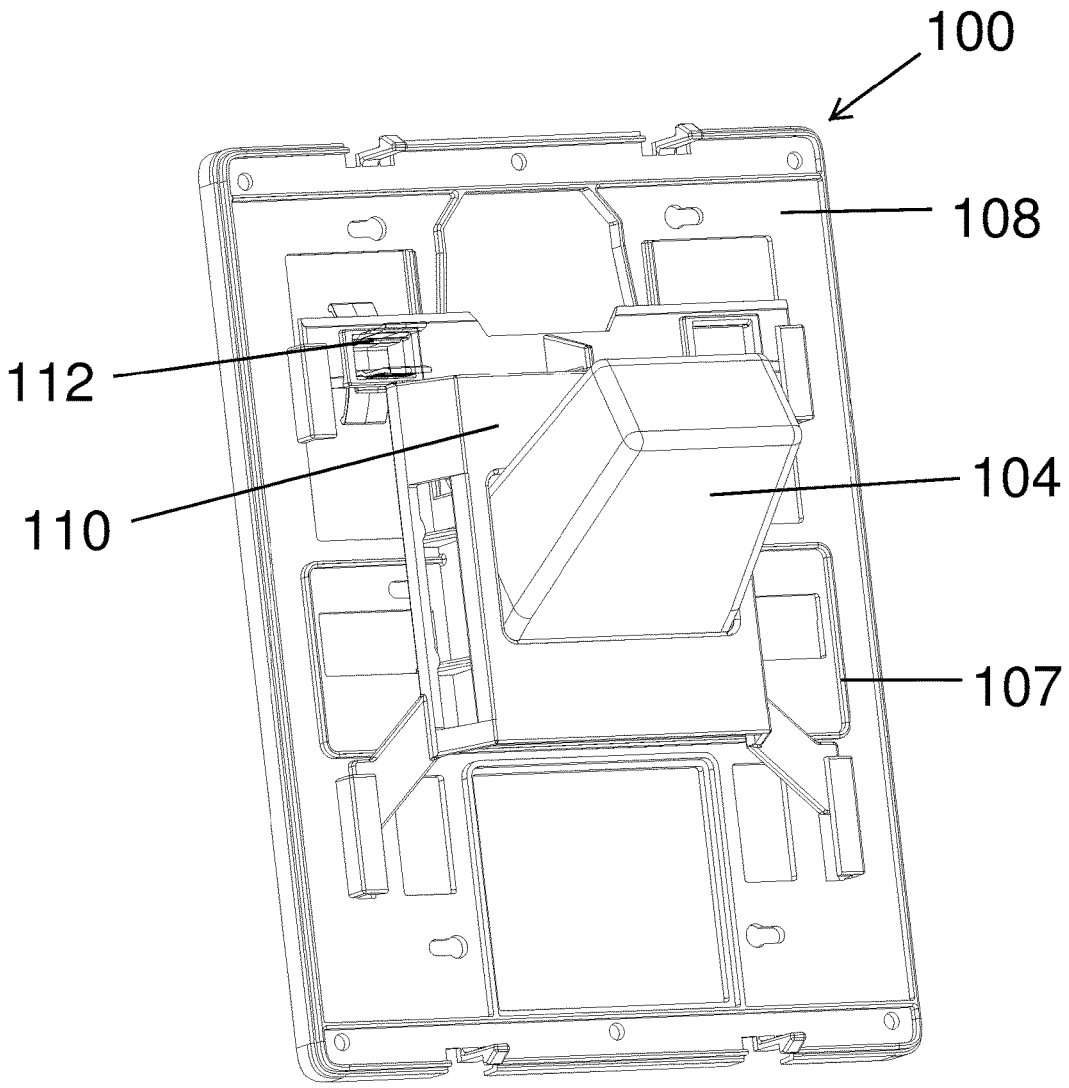
FIG. 4 is a perspective front view of an oversized operational novelty wall switch cover assembly with the cover and the slide trim plate removed according to an embodiment of the present invention.
Figure 5:
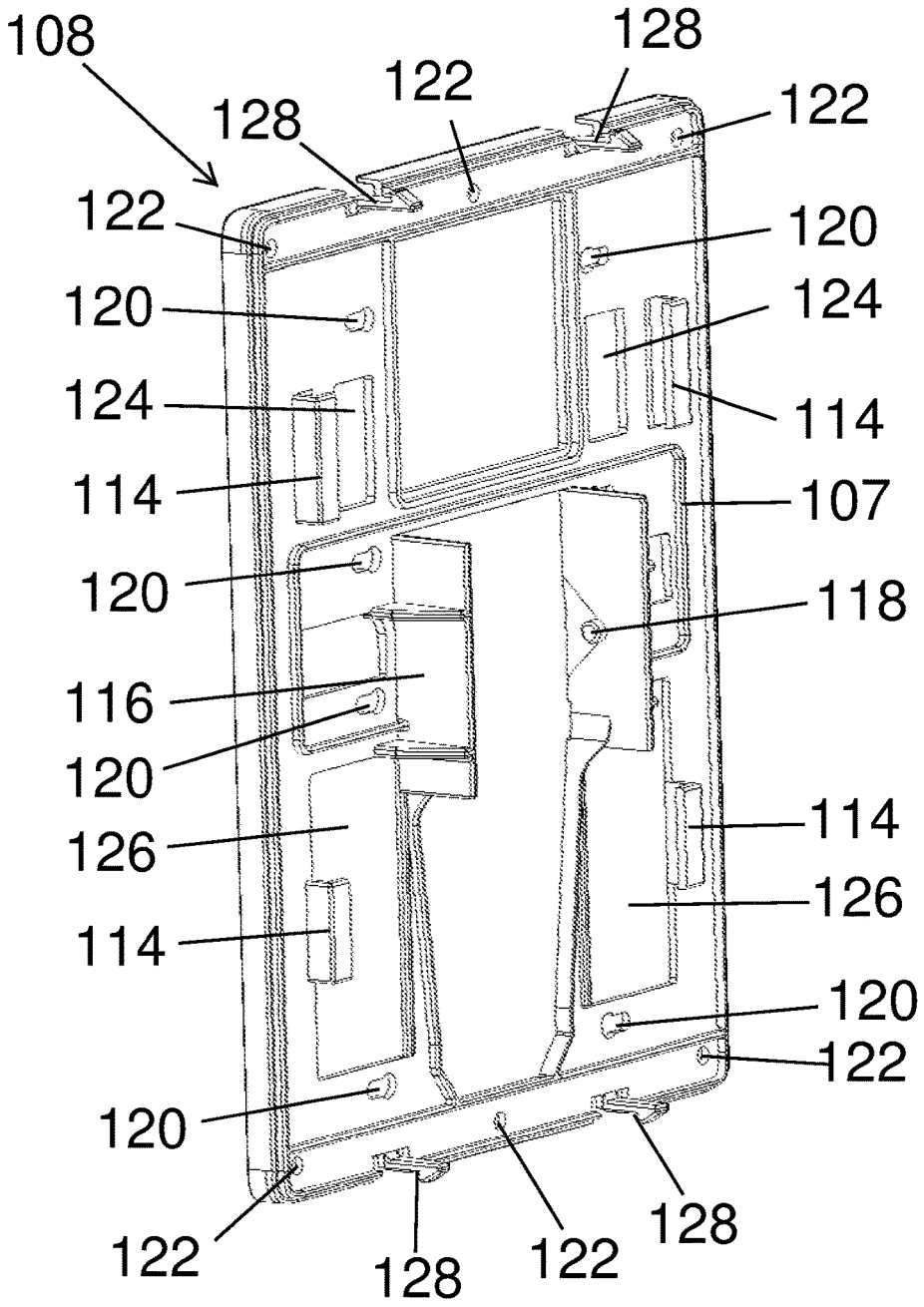
FIG. 5 is a perspective front view of the mounting plate according to the embodiment of the present invention.

The mounting plate 108 is best illustrated in FIGS. 4 & 5 and is substantially comprised of a generally planar structure 40 with stiffening features, such as ridges 107, and additional features provided thereon to facilitate operation of the assembly. Proximate a top edge of the plate and the bottom edge of the plate fastener holes 122 are provided through which fasteners can be received into and through to secure the mounting plate to a wall. Additionally, eight fastener keyholes 120 are provided vertically inwardly of the top and bottom edges respectively. These keyholes are positioned to align with the location of a threaded fastener location of a wall plate switch. In use, the applicable fastener is loosened from the wall plate switch over which the oversized novelty switch assembly is to be received and then tightened through the keyhole 120. The fastener keyholes comprise slots with one end of the slot being wider than the other whereby the head of the fastener can be slid through the wider portion and then the shank slid into the more narrow portion prior to tightening.

Near the center of the mounting plate a pair of spaced apart opposing parallel left and right toggle flanges 116 extend orthogonally from the planar structure 40. Each tab includes a horizontal inwardly extending cylindrical protrusion 118 that faces and is aligned with the protrusion on the opposing flange. The protrusions are configured to be pivotally received in opposing holes 146 in the left and right sidewalls of the large toggle lever 104 (see FIG. 8). Resilient give in the left and right sidewalls of the large toggle lever permit easy removal of the toggle lever from the mounting plate as necessary or desired. In the illustrated mounting plate, a rectangular opening is provided between the opposing tabs. This opening is not necessary to the functionality of the assembly and can vary or be eliminated in variations and alternative embodiments.

Along and proximate the left and right sides of the planar structure, receiving four slot structures 114 (two on each side) are provided that form pairs of opposing vertically-extending slots that receive and slidably retain the sliding member (or slider) 110 therein. The slot structures permit the slider to move vertically upwardly and downwardly responsive to the movement of the toggle lever, but prevent lateral movement thereof.

Upper and lower attachment features 128 are provided along the respective top and bottom sides of the mounting plate 108 to mate with and removably secure the cover 102 to the mounting plate. Along the top and bottom sides of the mounting plate, the attachment features each comprise a tab 128 that extends orthogonally from the planar structure and includes a ridge that extends outwardly from its distal edge. The ridge is configured to be snappily received over a corresponding lip 158 provided on a respective top or bottom sidewall of the cover (See FIG. 9).

With reference to FIG. 5, two smaller rectangular openings 124 are provided inwardly of the respective the upper left and right slot structures 114 and below the upper wall plate switch fastener keyholes 120. Note that references to left, right, top and bottom for the mounting bracket (and other components as well) are relative to the Figures and not necessarily indicative of the orientation of the bracket in use. These openings are sized to receive the small toggle 302 of a toggle style light switch there through to interface with the slider 110 (See FIG. 12).

Two larger rectangular openings 126 are provided inwardly of the respective lower left and right slot structures 114 and below the lower wall plate switch fastener keyholes 120. These openings are sized to permit access to a rocker panel 202 of a rocker style light switch 200 to interface with a wall switch rocker actuator 112 of the slider assembly 110 (See FIG. 11).

The mounting bracket 108 is typically comprised of plastic, such as ABS, and is typically injection molded, although the bracket can be fabricated by other means and can be comprised of other materials. As can be seen in FIG. 5, raised ridges are provided around the perimeter of the bracket and around the perimeter of several of the openings. These features provide for the stiffening and strengthening of the bracket and can vary significantly and substantially in different variations. Further, the raised ridge 107 extending outwardly from the backside around the perimeter of the bracket has a height that is typically equal or greater than the thickness of a light switch wall plate so that the wall plate of the underlying wall switch when the bracket is installed thereover does not prevent the mounting bracket from mounting flush to the surrounding wall.

Figure 6A:
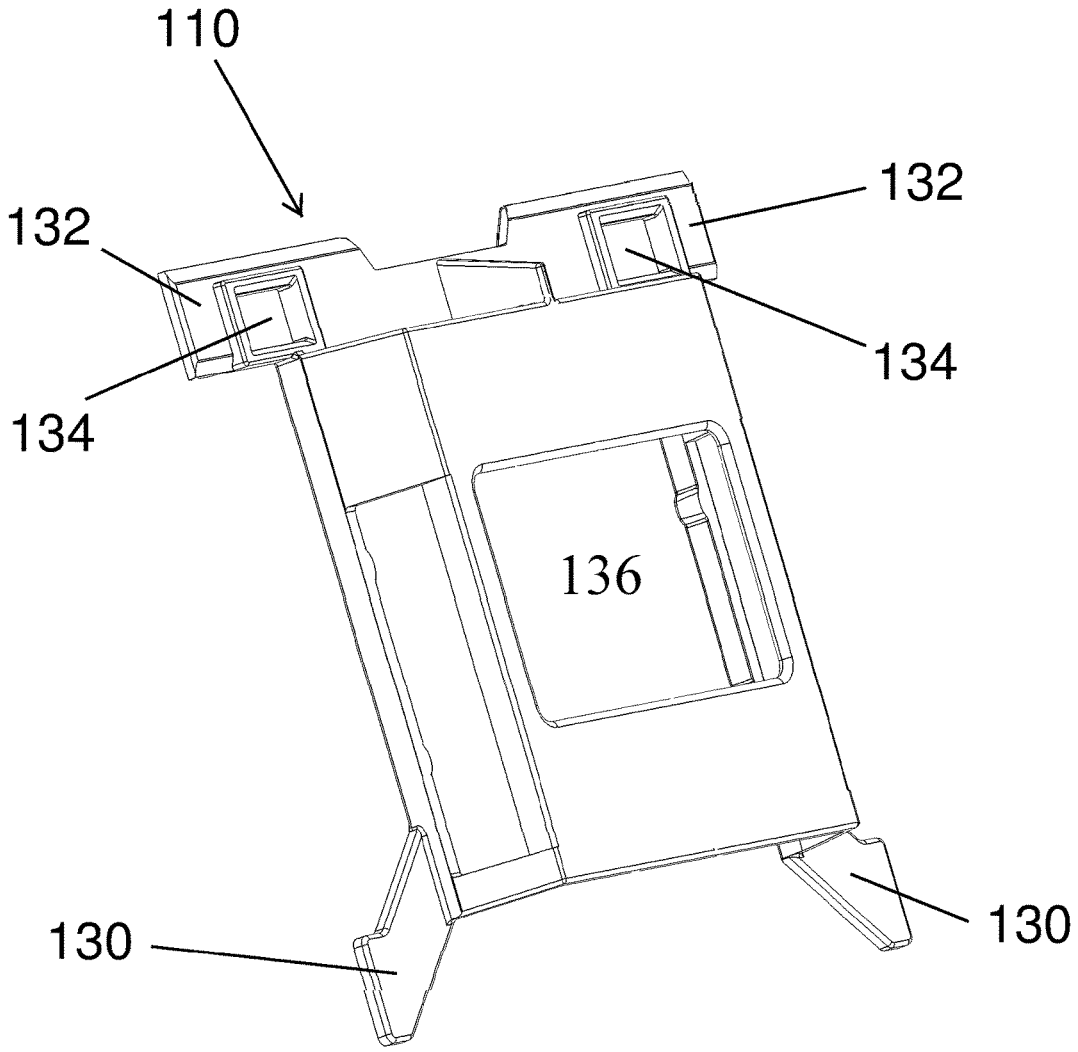
FIGS. 6A&B are perspective front and back views of the slider according to the embodiment of the present invention.
Figure 6B:
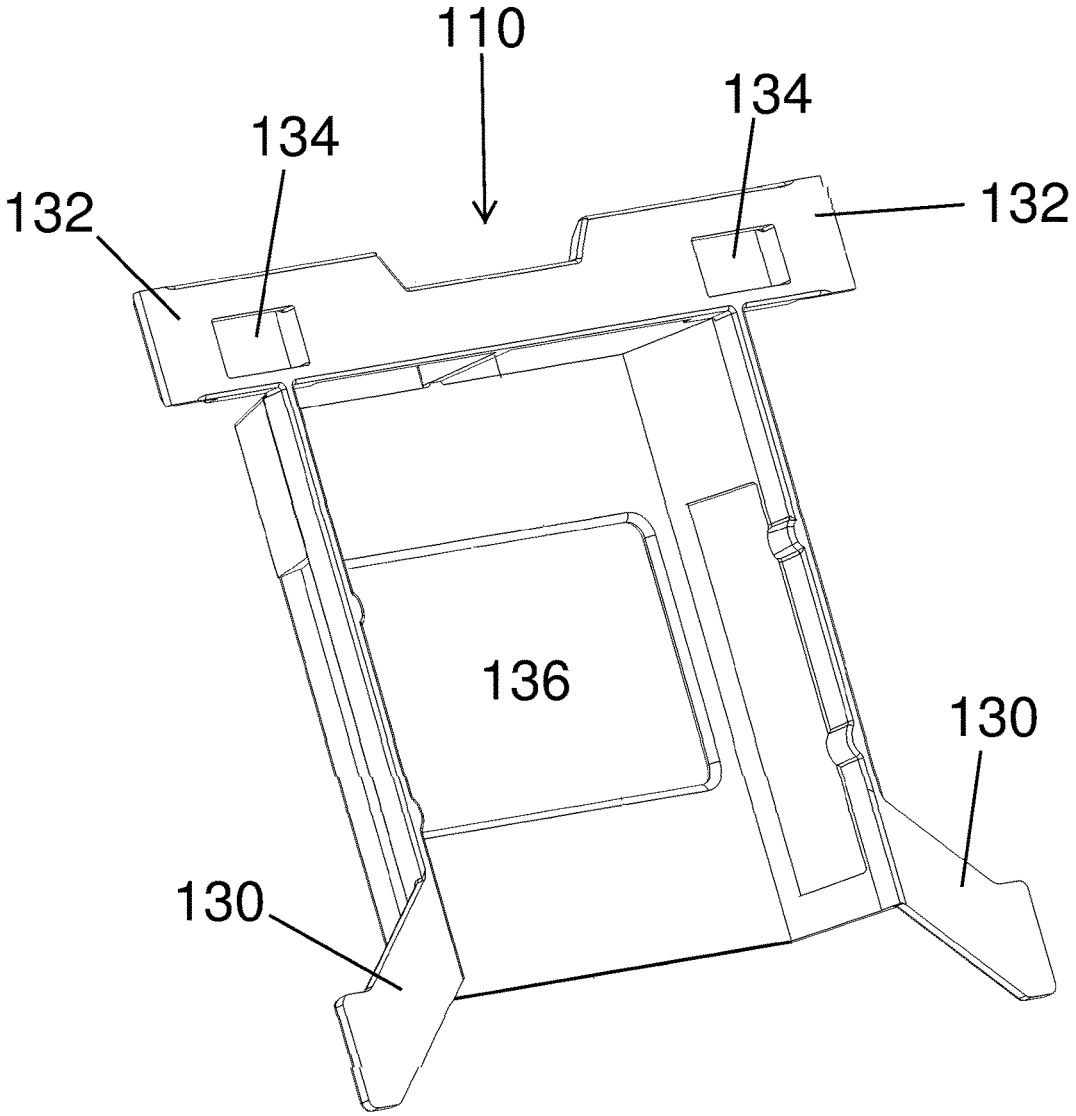

The slider 110 is best shown in FIGS. 6A&B. It comprises a raised central planer portion that includes a rectangular large toggle opening 136 therein. The large toggle opening is configured to receive the large toggle 104 therethrough as can be best seen in FIG. 4. As the large toggle is pivoted the top and bottom sides of the toggle interface with the top and bottom edges of the opening causing the slider to move linearly up and down. When installed on the mounting plate, the raised central planer portion is positioned above or in front of the underlying left and right toggle flanges 116 of the mounting bracket 110.

Left and right sides of the slider 110 extends rearwardly at an acute angle configured to avoid interfering with stiffening features on the left and right toggle flanges. Proximate the top of the slider a first pair of opposing flanges extend outwardly terminating in left and right ends 132, which are received in a slidable arrangement in the upper left and right slot structures 114 respectively. Similarly, proximate the bottom of the slider a first pair of opposing flanges extend outwardly terminating in left and right ends 130, which are received in a slidable arrangement in the lower left and right slot structures 114 respectively. The upper flanges include small left and right rectangular openings 134 inward of the respective left and right ends. This opening serves as a wall switch actuator by receiving the small toggle lever 302 of a toggle-style switch therein. Further, the opening is also adapted to snappily receive a second type of actuator 112 (see FIGS. 7 & 11) therein for use in actuating rocker style wall switches 200.

Figure 7:
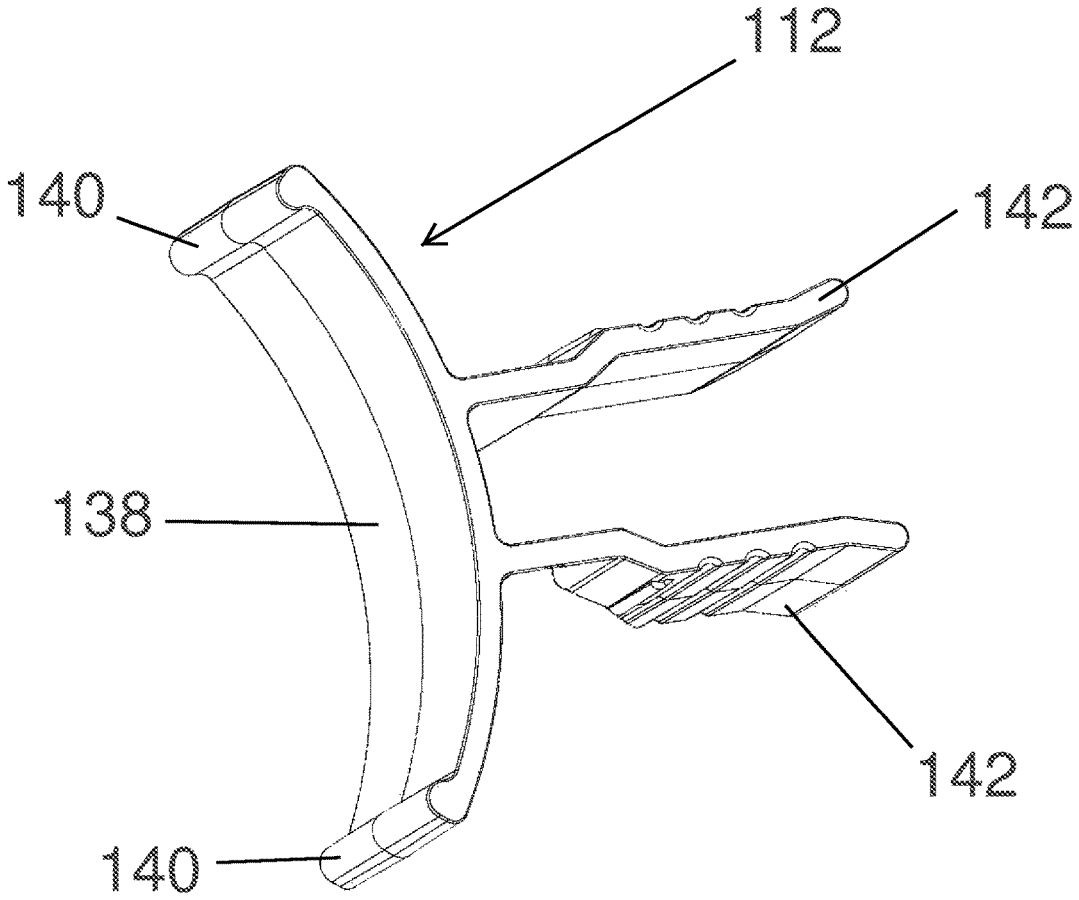
FIG. 7 is a perspective front view of a wall switch actuator of the slider assembly for rocker-style wall switches, according to the embodiment of the present invention.

The rocker or second type of actuator 112 is shown in FIG. 7. It includes a first portion 142 that can be snappily received in the small left and right rectangular openings 134 to secure them in place. The opposing portion comprises a rectangular arcuate plate 138 terminating in first and second ends 140. The ends make contact with the rocker actuator of the rocker-style wall switch when the assembly 100 is installed and by moving upwardly and downwardly actuate the rocker and turn the wall switch off and on.

Figure 8:
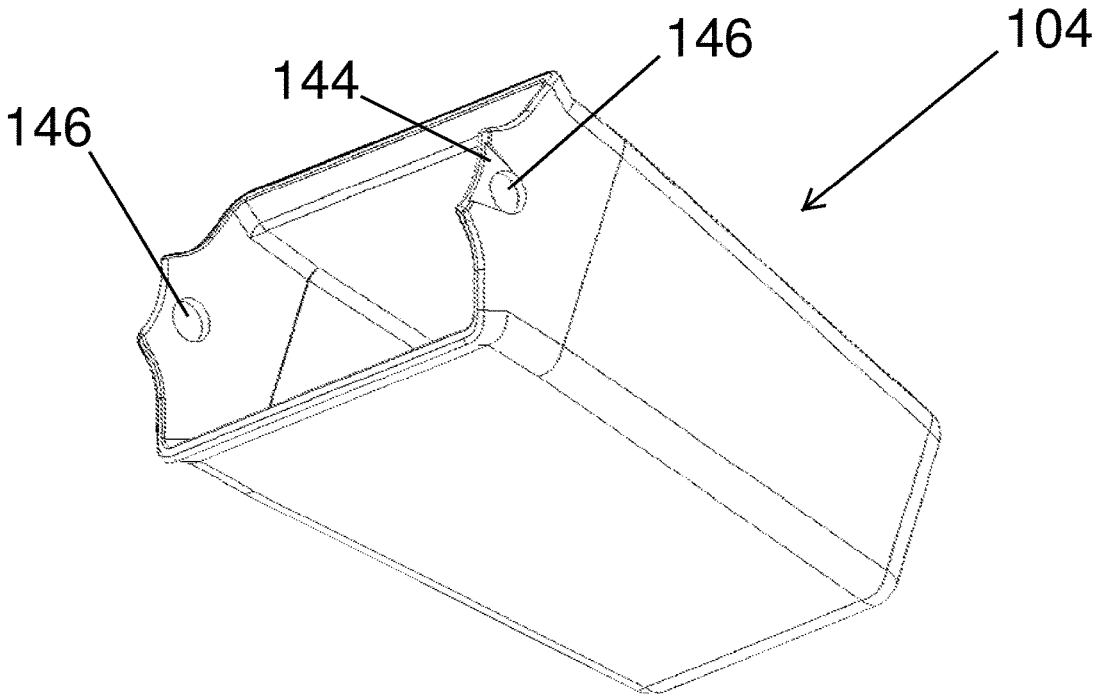
FIG. 8 is a perspective back view of the large toggle lever according to the embodiment of the present invention.

The large toggle lever 104 is best shown in FIG. 8 and resembles a typically light switch toggle lever only much larger. The lever includes left and right opposing holes 146 in the left and right sidewalls that are configured to received the horizontally extending protrusions 118 of the mounting bracket toggle flanges 116 permitting pivotal movement of the lever relative to the mounting plate 104. As can be clearly seen in FIG. 8, the area 144 around the opposing holes on the exterior surface of the respective sidewall is recessed near the proximate edge of the lever. This recessed area acts as a guide for the protrusions 118 to make attaching the large toggle lever to the mounting bracket easier. The lever is further received through the slider and as described above to facilitate the sliding movement of the slider when the lever is pivoted.

The toggle lever 104 is typically comprised of a polymeric material and is typically fabricated using injection molding. The left and right sidewalls of the lever are generally thin permitting a user to squeeze the sidewalls together to sufficiently to release the lever from the protrusions 118 on the toggle flanges 116. Accordingly, a user can as desired change out the lever for other levers. For instance, during football season, a fan may want to have his/her wall switch to have an orange toggle lever showing support for the Denver Broncos™, but he/she may want to switch to a purple lever in baseball season to represent the Colorado Rockies™. As is discussed below, lever 104, cover 102, and slide trim plate 106 accessory pack can be sold separately to allow an owner of the large switch to change out its look.

Figure 10:
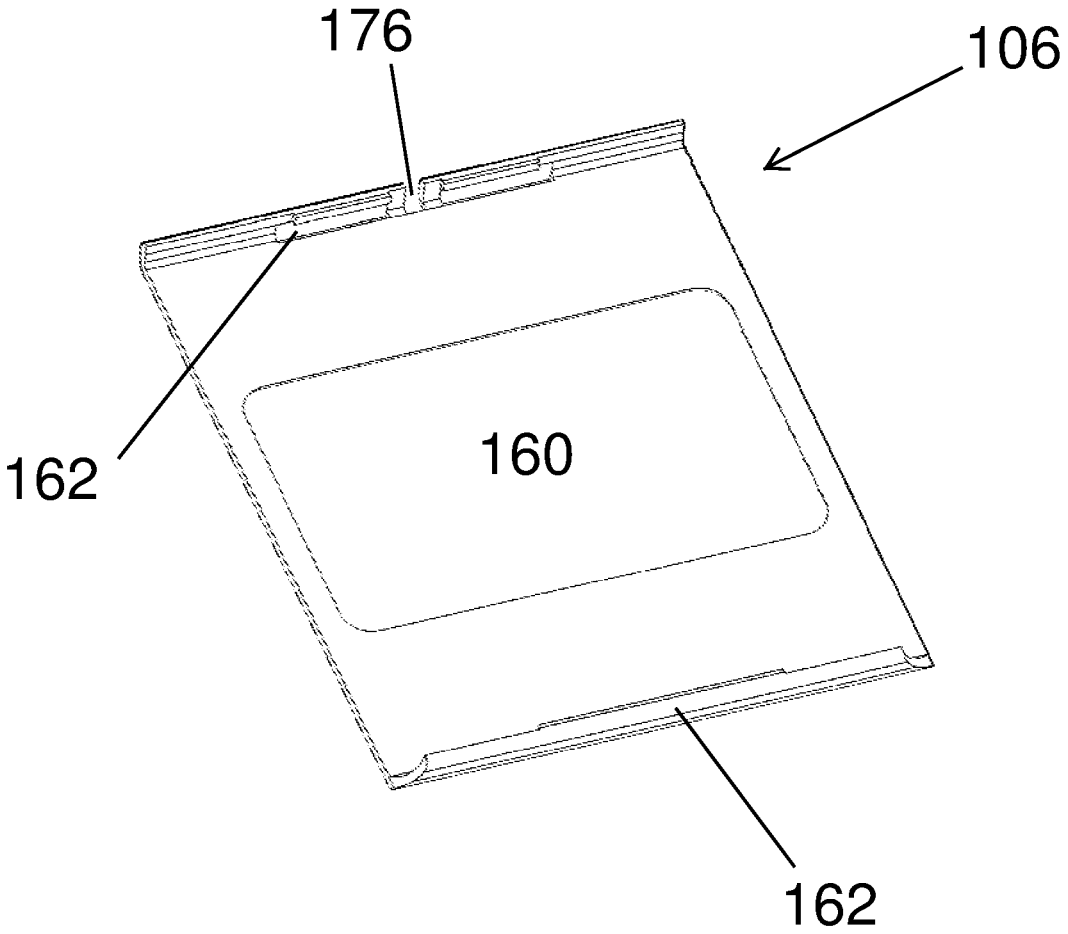
FIG. 10 is a perspective back view of the slide trim plate according to the embodiment of the present invention.
Figure 11:
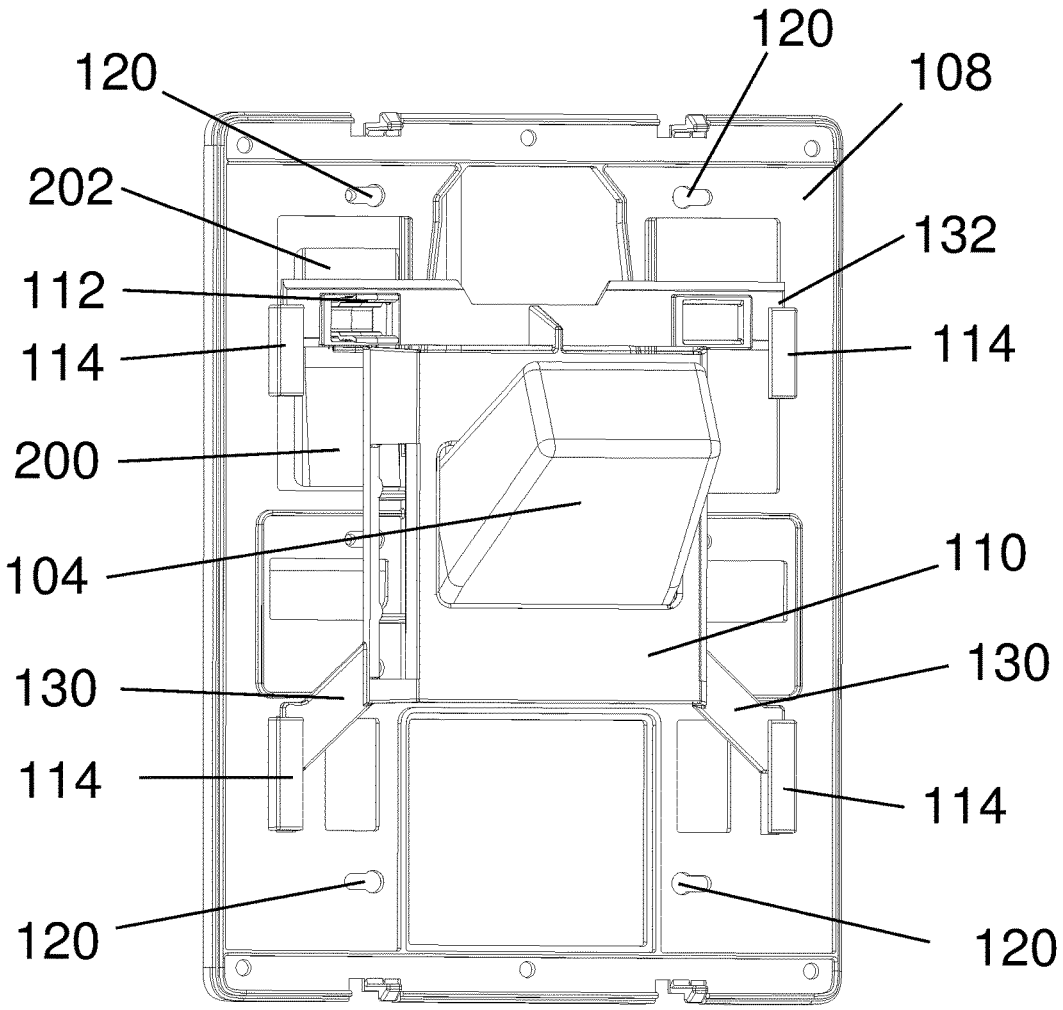
FIG. 11 is a perspective front view of the oversized operational novelty wall switch cover assembly with the cover and slide trim plates removed in combination with a rocker-style wall switch according to the embodiment of the present invention.
Figure 12:
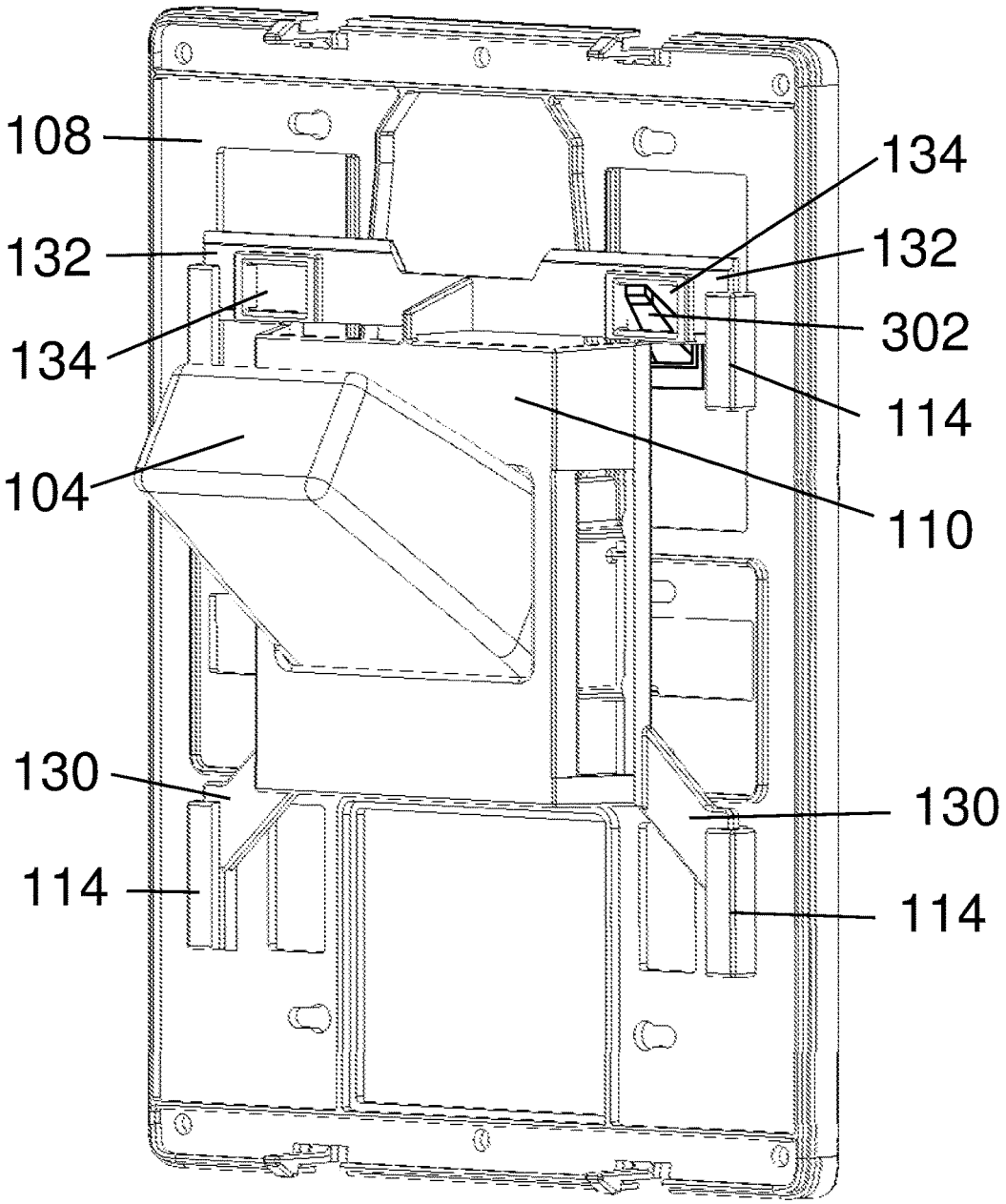
FIG. 12 is a perspective front view of the oversized operational novelty wall switch cover assembly with the cover and slide trim plate removed in combination with a toggle-style wall switch according to the embodiment of the present invention.

The planar slide trim plate 106 as best shown in FIG. 10 also has a lever rectangular opening 160 similarly sized to the lever rectangular opening in the slider 110. The slide trim plate fits over the lever and rests on the surface as a unit of the slider. Curved top and bottom ends of the plate form retaining clips 162 and a register slot 176 that help position and hold the plate in place once installed. It is configured to move upwardly and downwardly as a unit with the slider as a result of pivoting the large toggle lever 104. It is available in different colors allowing further customization of the assembly.

Figure 9:
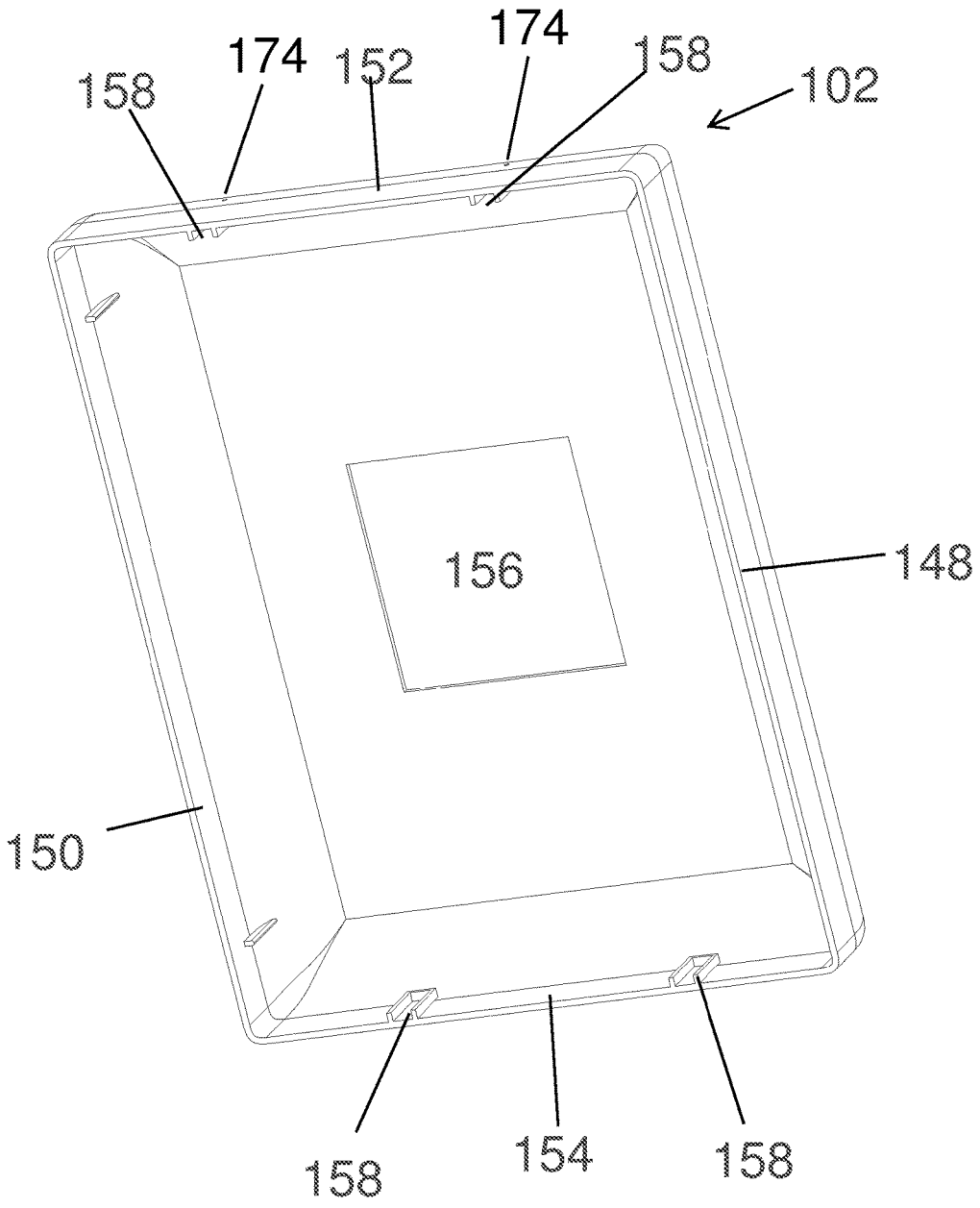
FIG. 9 is a perspective back view of the cover according to the embodiment of the present invention.

The cover 102 as best shown form the back side in FIG. 9 comprises a flat front side with a cover lever rectangular opening 156. Unlike the rectangular openings of the slider 110 and the slide trim plate 106, it has a greater length such that the top and bottom sides of the large toggle lever 104 do not impact the top and bottom edges of the opening except possibly when the lever is fully in either its upper or lower position.

Along the edges of the flat front side of the cover 102 left, right, top bottom sidewalls 148-154 extend orthogonally therefrom. The width of the sidewalls is sufficient so that the front side is located above and over the slider 110 and slide trim plate 106 when the cover is attached to the mounting plate 108. As described above the top and bottom sidewalls 152 & 154 of the cover include attachment features 158 configured to mate with the attachment features of the mounting plate 128. The attachment features permit the cover to be snapped in place over the mounting plate there by providing a finished look to the wall switch assembly. Release port holes 174 are typically provided on the top of the cover that permit a user to insert a pin, nail, or a provided release tool 164 therethrough to depress the attachment features 128 of the mounting plate and release the cover from the plate.

In some variations, the cover 102 can be painted a desired color and/or include logos or other indicia imprinted thereon. For instance the front side of the cover could include the logos and colors of a favorite sports team. Further, as discussed above, the large toggle lever 104 can also be provided in a coordinating or contrasting color.

Figure 13:
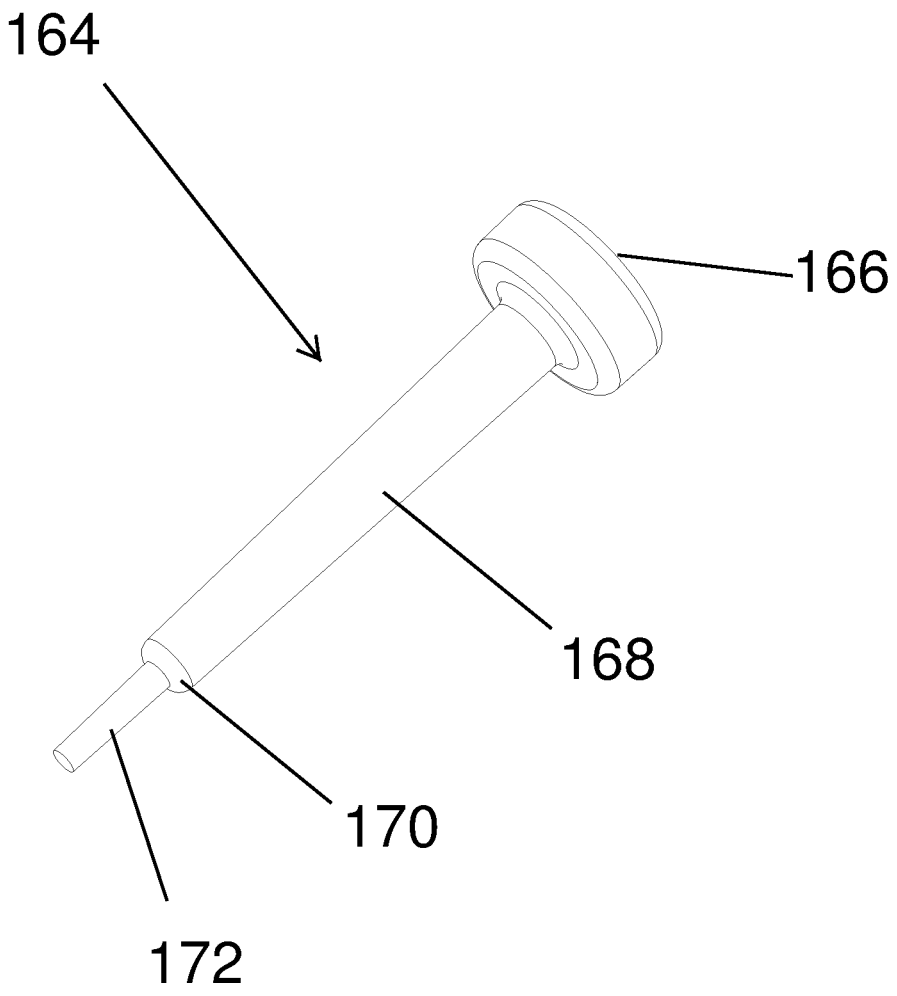
FIG. 13 is a perspective view of a cover plate removal tool according to the embodiment of the present invention.

An embodiment of a release tool is shown in FIG. 13. It can be made of any suitable material but is typically injection molded of plastic. The proximal end comprises a thumb platform 166. A shank 168 extends downwardly from the platform to a shoulder 170 from which a much thinner release shaft 172 continues to the distal end. The shoulder acts as a stop limiting the distance the tool can be inserted into the release port holes helping ensure the user does not inadvertently bend the attachment features 128 too far causing them to break.

A Method of Installing an Operational Oversized Wall Switch Cover Assembly

Initially, an installer must determine where he/she would like to install the oversized wall switch. Once a location is determined, the orientation and positioning of the mounting plate 108 must be determined relative to the switch. If the wall switch over which the oversized wall switch is to be installed is a rocker style switch, the rocker of the wall switch must be aligned with one of the larger rectangular openings 126. If the wall switch is of the toggle-style, the small toggle lever is typically installed aligned with the smaller rectangular opening 124.

Depending on the location of windows, doorways, and other features on the wall on which the oversized wall switch is to be installed the orientation of the plate must be determined. For instance, the existing wall switch can be located under any one of the top left, top right, bottom left and bottom right regions of the mounting bracket allowing the installer to pick a location in most installations that is free of any obstructions.

When installing the oversized wall switch over a rocker-style wall switch, the rocker actuator 112 is installed in one of the small left and right rectangular openings 134 of the slider 110. When being installed over a toggle-style wall switch, one of the small left and right rectangular openings 134 of the slider 110 acts as the actuator. The slider is most typically installed on the mounting bracket prior to installation of the mounting bracket on the wall.

In embodiments, having a slide trim plate 106, the plate is installed so that it provides another potential color customization for the oversized wall switch. The slide trim plate can be installed before or after the mounting bracket is fixed to the wall over the wall switch.

The large toggle lever is installed through the rectangular opening 136 of the slider and over the protrusions 118 of the toggle flanges 116. To facilitate connection of the opposing holes 146 of the large toggle lever can be squeezed inwardly as the sides are slid over the protrusions 118 until they are snappily received.

The mounting plate is secured to the wall by way of two or more fasteners passing through the plurality of mounting holes 120 & 122. Typically, both the top and bottom screws securing the wall plate of the wall switch to the wall plate housing are loosened and passed through the appropriate opening 120 in the mounting bracket to secure the bracket to the wall switch. Of significance, typical installations do not require the removal of the wall plate of the underlying light switch. Rather the mounting bracket is installed over the wall plate of the existing light switch. Further, fasteners are passed through one or more of the remaining mounting holes 122. As necessary drywall anchors can be used to help secure the additional fasteners into the wall. In place of drywall anchors, double sided tape can be utilized to assist in securing the mounting plate to the wall.

Once secured in place the various components of the oversized wall switch assembly can attached to the mounting bracket, the cover 102 is snapped in place.

A Method of Operating an Oversized Wall Switch Cover Assembly

Operationally, the oversized wall switch operates in a similar fashion to the normal sized operational light switch it overlies. Pivoting the large toggle lever 104 upwardly moves the slider 110 upwardly, which causes the slider assembly actuator to interface with either the small toggle or rocker of the underlying wall switch to pivot upwardly and activate the switch. Similarly, by pivoting the large toggle lever downwardly the slider moves downwardly, which causes the slider assembly actuator to interface with the small toggle or rocker of the underlying wall switch and pivot it downwardly to deactivate the switch.

Variations and Other Embodiments

The various embodiments, methods and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention. For instance, the large toggle lever and the cover could be configured to resemble a large industrial switch, such as, but not limited to, a double pole knife switch.

We claim:

1. An oversized wall switch assembly comprising:

a mounting plate, the mounting plate including (i) a plurality of mounting holes, (ii) one or more vertically-extending slots, (iii) cover attachment features, and (iv) left and right toggle attachment flanges;

a large toggle lever, the large toggle lever being pivotally received in the toggle attachment flanges;

a slider assembly, a section of the slider being slideably received in the one or more vertically-extending slots, the slider including a first large toggle opening adapted to receive the large toggle lever therethrough and at least a first wall switch actuator, the first wall switch actuator configured to interface with an on/off actuator of an electrical wall switch therein when the mounting plate is secured to the wall switch by way of one or more of the plurality of mounting holes; and a cover, the cover including (a) mounting plate attachment features interfacing with the cover attachment features to secure the cover to the mounting plate and (b) a second large toggle opening, the large toggle lever being received through the second large toggle opening;

wherein pivotal movement of the large toggle lever causes the slider to slide along the at least one vertically orientated slot moving the first wall switch actuator vertically upwardly or downwardly.

2. The oversized wall switch assembly of claim 1, further comprising a slide trim plate, the slide trim plate having an third large toggle opening, the slide trim plate being positioned over the large toggle lever between the slider and the cover.

3. The oversized wall switch assembly of claim 2, wherein the slide trim plate is a different color than the cover.

4. The oversized wall switch assembly of claim 1, wherein the assembly is at least 6" wide and at least 8" long.

5. The oversized wall switch assembly of claim 1, wherein the first wall switch actuator comprises a small toggle lever opening, the small toggle lever opening configured to receive a toggle lever of a wall switch therein when the mounting plate is secured to the wall switch by way of the one or more of the plurality of mounting holes.

6. The oversized wall switch assembly of claim 1, wherein the first wall switch actuator comprises a pair of spaced apart protrusions, the pair of spaced apart protrusions configured to rest against a rocker of a wall switch when the mounting plate is secured to the wall switch by way of the one or more of the plurality of mounting holes.

7. The oversized wall switch assembly of claim 5, including a second wall switch actuator comprising a pair of spaced apart protrusions, the pair of spaced apart protrusions configured to rest against a rocker of a wall switch when the mounting plate is secured to the wall switch by way of the one or more of the plurality of mounting holes.

8. The oversized wall switch assembly of claim 1, wherein (a) the first wall switch actuator comprises a small toggle lever opening, the small toggle lever opening configured to receive a toggle lever of a wall switch therein when the mounting plate is secured to the wall switch by way of the one or more of the plurality of mounting holes (b) the slider assembly includes a second wall switch actuator piece comprising a pair of spaced apart protrusions configured to rest against a rocker of a wall switch when the mounting plate is secured to the wall switch by way of the one or more of the plurality of mounting holes, and (c) the second wall switch actuator piece being securely received in the first wall switch actuator.

9. The oversized wall switch assembly of claim 1, wherein the at least one vertically extending slot comprises opposing first and second vertically extending slots, the first vertically extending slot being located proximate a left side of the mounting plate and the second vertically extending slot being located proximate a right side of the mounting plate.

10. The oversized wall switch assembly of claim 9, wherein each vertically extending slot is defined by inside surfaces of a respective elongated L-shaped protrusion and a portion of a top surface of the mounting plate underlying the L-shaped protrusion, the L-shaped protrusion being molded into the mounting plate.

11. The oversized wall switch assembly of claim 1, wherein the cover attachment features comprise (i) a first cover attachment feature located along a top edge of the mounting plate and (ii) a second cover attachment feature located along a bottom edge of the mounting plate, wherein the mounting plate attachment features comprise (a) a first mounting plate attachment feature located along a top edge of the cover and (b) a second mounting plate attachment feature located along a bottom edge of the cover, and wherein the first cover attachment feature interfaces with the first mounting plate attachment feature and the second cover attachment feature interfaces with the second mounting plate attachment feature to secure the cover to the mounting plate.

12. The oversized wall switch assembly of claim 1, wherein one of (i) left and right sides of the large toggle lever and (ii) the left and right toggle attachment flanges include outwardly extending left and right prongs, and the other of the left and right sides of the large toggle lever and the left and right toggle attachment flanges include respective left and right holes provided therein, and wherein the left prong is pivotally received in the left hole and the right prong is pivotally received in the right hole.

13. The oversized wall switch assembly of claim 1, wherein the assembly is comprised primarily of plastic.

14. The oversized wall switch assembly of claim 2, wherein exclusive of any mounting fasteners, spacers and release tool, the assembly consists of no more than five plastic pieces.

15. The oversized wall switch assembly of claim 1, wherein indicia is imprinted on an outside surface of the cover, toggle and slide trim plate.

16. The oversized wall switch assembly of claim 15, wherein the indicia comprises a name and logo of a sports team.

17. A method of installing the oversized wall switch assembly of claim 15, the method comprising:

providing the oversized wall switch assembly;

aligning the wall switch actuator with the on/off actuator so that the wall switch actuator moves the on/off actuator into an off position when the large toggle lever is pulled to a down position and the wall switch actuator moves the on/off actuator into an on position when the large toggle lever is pulled to an up position;

once positioned, securing the mounting plate to the wall; and attaching the cover to the mounting plate using the cover attachment features and the mounting plate attachment features.

18. The method of claim 17, wherein said securing the mounting plate to the wall comprises passing at least one threaded fastener through a mounting hole in the mounting plate and threading the threaded fastener into a threaded hole in the wall switch.

19. The method of claim 18, wherein the electrical wall switch comprises a rocker on/off actuator.

* * * * *